United States Patent [19]

Wolf

[11] 4,254,954

[45] Mar. 10, 1981

[54] TORTOISE AND HARE GAME

[76] Inventor: Tobin Wolf, 285 Aycriff Ave., Passaic, N.J. 07006

[21] Appl. No.: 103,967

[22] Filed: Dec. 17, 1979

Related U.S. Application Data

[62] Division of Ser. No. 877,473, Feb. 13, 1978, Pat. No. 4,225,138.

[51] Int. Cl.[3] ..... A63F 3/00

[52] U.S. Cl. ..... 273/144 B

[58] Field of Search ..... 273/287, 243, 144 R; 46/103, 123

[56] References Cited

U.S. PATENT DOCUMENTS

| | | | |
|---|---|---|---|
| 160,234 | 2/1875 | Reidinger | 273/108 |
| 459,997 | 9/1891 | Cromwell | 273/108 |
| 1,212,332 | 1/1917 | Almida | 46/103 |
| 1,722,986 | 7/1929 | McAlice | 273/144 B |
| 3,106,402 | 10/1963 | Rushing | 273/144 B |
| 4,078,799 | 3/1978 | Lahr | 46/262 |

FOREIGN PATENT DOCUMENTS

| | | | |
|---|---|---|---|
| 921738 | 7/1949 | Fed. Rep. of Germany | 273/108 |
| 802922 | 2/1951 | Fed. Rep. of Germany | 46/211 |
| 1230557 | 3/1959 | France | 273/108 |
| 488754 | 7/1938 | United Kingdom | 46/123 |

*Primary Examiner*—Richard C. Pinkham
*Assistant Examiner*—Carl Moy
*Attorney, Agent, or Firm*—Jay M. Cantor

[57] ABSTRACT

A game capable of being played by one or more players wherein the object is to beat the tortoise to the finish line and/or also beat the competing players. The game includes a gameboard which has a circular path defined thereon for the tortoise with a guide ring to guide the circular travel path of the tortoise. In addition, a tortuous path is provided for movement of the rabbits. The tortuous path is composed of plural spaces of different colors. The tortoise includes an interior standard spring motor which when wound drives a shaft which includes a drive wheel at one end positioned beneath the tortoise and a ball tumbler including a plurality of different colored balls and a window or windows positioned above the tortoise. The tortoise also includes a depending plate so that the tortoise is supported by means of a pair of spaced dimples on the plate and the drive wheel. When the tortoise place on its path, the drive wheel will rotate and cause the tortoise to traverse the circular path, the radius of curvature of the path being designed to be less than that of the circular guide ring so that the tortoise is guided around the circular path by the guide ring. Since the drive wheel is powered by the same shaft as the ball tumbler, the rotation of the shaft will cause different colored balls to be seen at a window. These balls are used in accordance with the game rules to permit movement of the rabbits in the prescribed manner.

2 Claims, 5 Drawing Figures

65
61
63
63
67
67
39
59
55

TORTOISE AND HARE GAME

This is a division of Ser. No. 877,473 filed Feb. 13, 1978, now U.S. Pat. No. 4,225,138.

BACKGROUND OF THE INVENTION

1. Field of the Invention

This invention relates to an improvement in a game of chance which can be played by one or more competitive players. Competition can be either against or among the players or between a player and/or players and a tortoise or other standard.

2. Description of Prior Art

Numerous toys and games have been utilized in the prior art wherein a standard spring motor is used. However, none of these prior art toys or games have utilized such motor in conjunction with a unique combination of driving mechanism and chance device for use in a game of chance which can be played by one or more competitive players.

SUMMARY OF THE INVENTION

Briefly, in accordance with the present invention, there is provided a game capable of being played by one or more players wherein the object is, in the case of one player, to have the player's hare or rabbit beat the tortoise to the finish line and, in the case of plural players, to beat the tortoise to the finish line and/or also beat the competing players. The game includes a gameboard which has a circular path defined thereon for the tortoise with a guide ring to guide the circular travel path of the tortoise. In addition, a tortuous path is provided for movement of the rabbits. The tortuous path is composed of plural sections or spaces of different colors, the path also including reward and penalty spaces. The tortoise includes an interior standard spring motor which is wound and drives a shaft which includes a drive wheel at one end positioned beneath the tortoise and a ball tumbler including a plurality of different colored balls and a window or windows positioned above the tortoise. The tortoise also includes a depending plate so that the tortoise is supported by means of a pair of spaced dimples on the plate and the drive wheel. When the spring motor has been wound up and the tortoise placed on its path, the drive wheel will rotate and cause the tortoise to traverse the circular path, the radius of curvature of the path being designed to be less than that of the circular guide ring so that the tortoise is guided around the circular path by the guide ring. Since the drive wheel is powered by the same shaft as the ball tumbler, the rotation of the shaft will cause different colored balls to be seen at a window. These balls are used in accordance with the game rules to permit movement of the rabbits in the prescribed manner.

BRIEF DESCRIPTION OF THE DRAWINGS

Referring now to the drawings;

FIG. 3 is a view taken along the line 3—3 of FIG. 2;

DESCRIPTION OF PREFERRED EMBODIMENT

Figure 1:
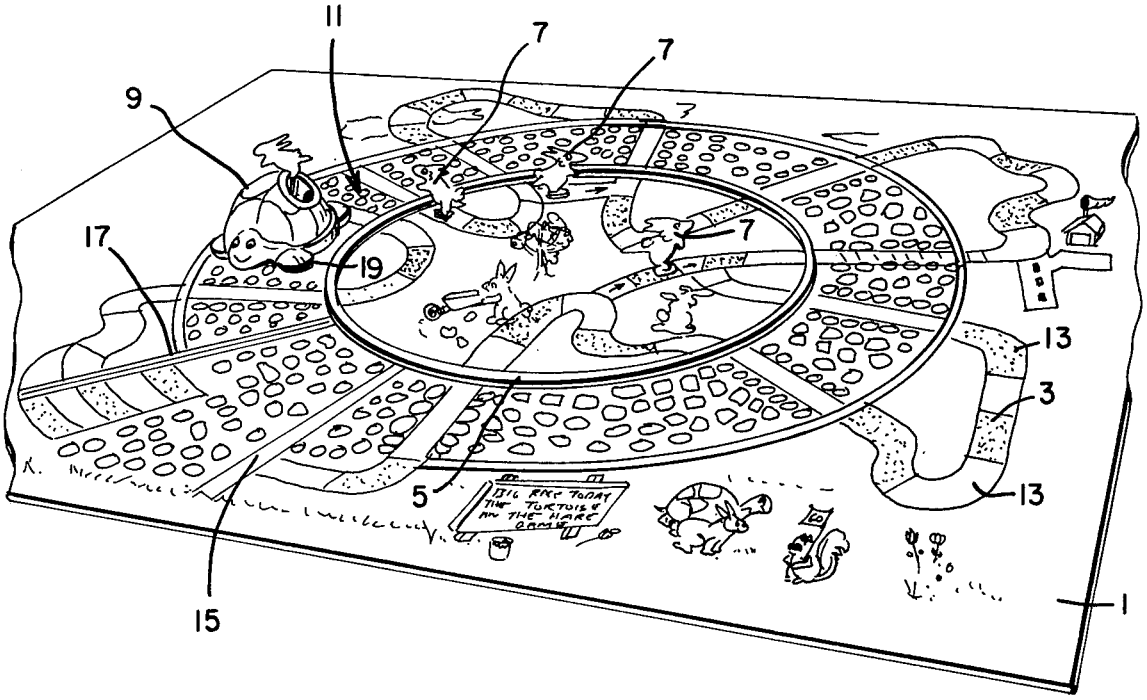
FIG. 1 is a perspective view of a gameboard with tortoise and rabbits thereon in accordance with the present invention.

Referring first to FIG. 1, there is shown a gameboard 1 on which is shown a tortuous path 3 which the rabbits 7 will traverse. The tortuous path 3 is composed of a plurality of spaces 13 of different colors, some of the spaces having reward or penalty designation as will be described hereinbelow. The tortuous path 3 also includes a start position 15 and a finish position 17 which are along lines which are designated start and finish for the path of traversal of the tortoise 9 on its circular path 11. The circular path 11, upon which the tortoise travels includes an interior guide ring 5 against which the tortoise is urged and causes the tortoise to maintain its circular path. At least one of the tortoise legs 19 and 21 will contact and follow the guide ring 5 and therefore maintain the tortoise movement in its forward direction around the circular path. As will be described hereinbelow, the tortoise is designed to travel in a path with a radius of curvature less than that of the guide ring so that the tortoise will bump into the guide ring 5 with one of its legs 19 and 21 while traversing its path and following along the guide ring thereafter.

Referring now to FIGS. 2 thru 5, the structure of the tortoise 9 is shown in greater detail. The tortoise 9 includes a housing 23 secured to a bottom plate 25 in standard manner as, for example, by gluing. A pair of spaced dimples 67 (only one shown in FIG. 4) are formed in plate 25 to provide support for the tortoise along with a drive wheel 43. A pedestal 27 (FIG. 4) is secured to the plate 25 and a motor mounting plate 28 is secured to plate 25 by means of eyelets or screws 29. The pedestal 27 is mounted to plate 25 at an acute angle to the tortoise axis. A standard spring motor is positioned on the plate 28 and includes a spring 31 secured in the U-shaped member 33 which, in turn, is secured to the plate 28. The spring 31 is wound up by rotation of the winding knob 35 on a shaft (not shown) in well known manner as described in detail in my U.S. Pat. Nos. 4,009,879 and 4,043,406. As the spring 31 unwinds, the gear 37 rotates against a pinion (not shown) on the shaft 39 and causes the shaft 39 to rotate. This rotation causes the gear 41 to rotate as well as the drive wheel 43 secured on the shaft 39. The ball tumbler 45, which will be described in more detail hereinbelow, also rotates along with the shaft 39 onto which it is mounted. The gear 41 further drives additional gears 47 and 49 on a shaft 51 which drive an escapement mechanism 53 to control the speed of the motor in well known manner as described in the above noted patents.

Figure 4:
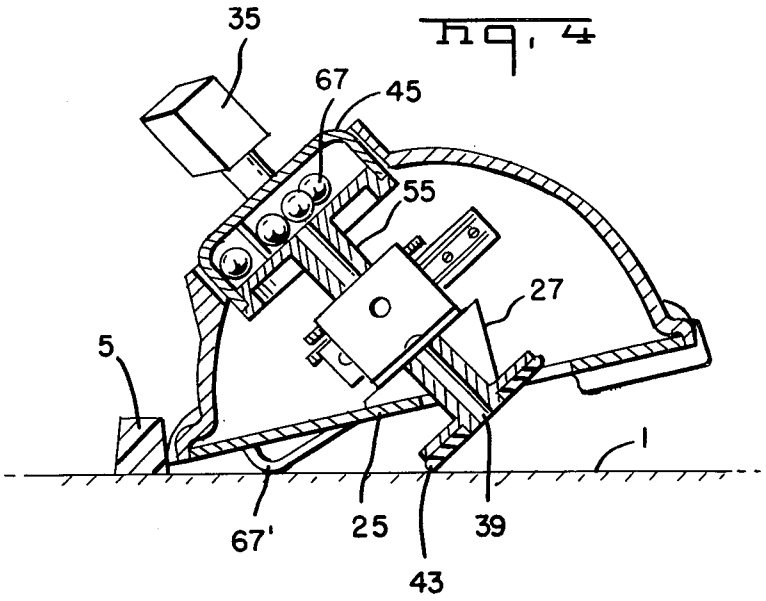
FIG. 4 is a view taken along the line 4—4 of FIG. 3 and shown in operating position on the gameboard.
Figure 7:
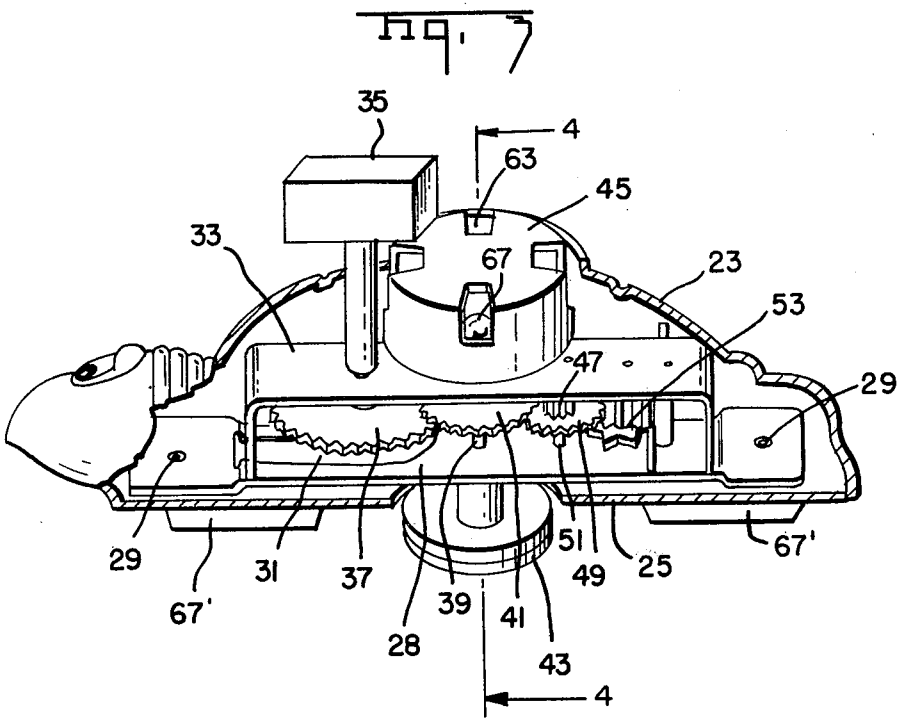
Figure 5:
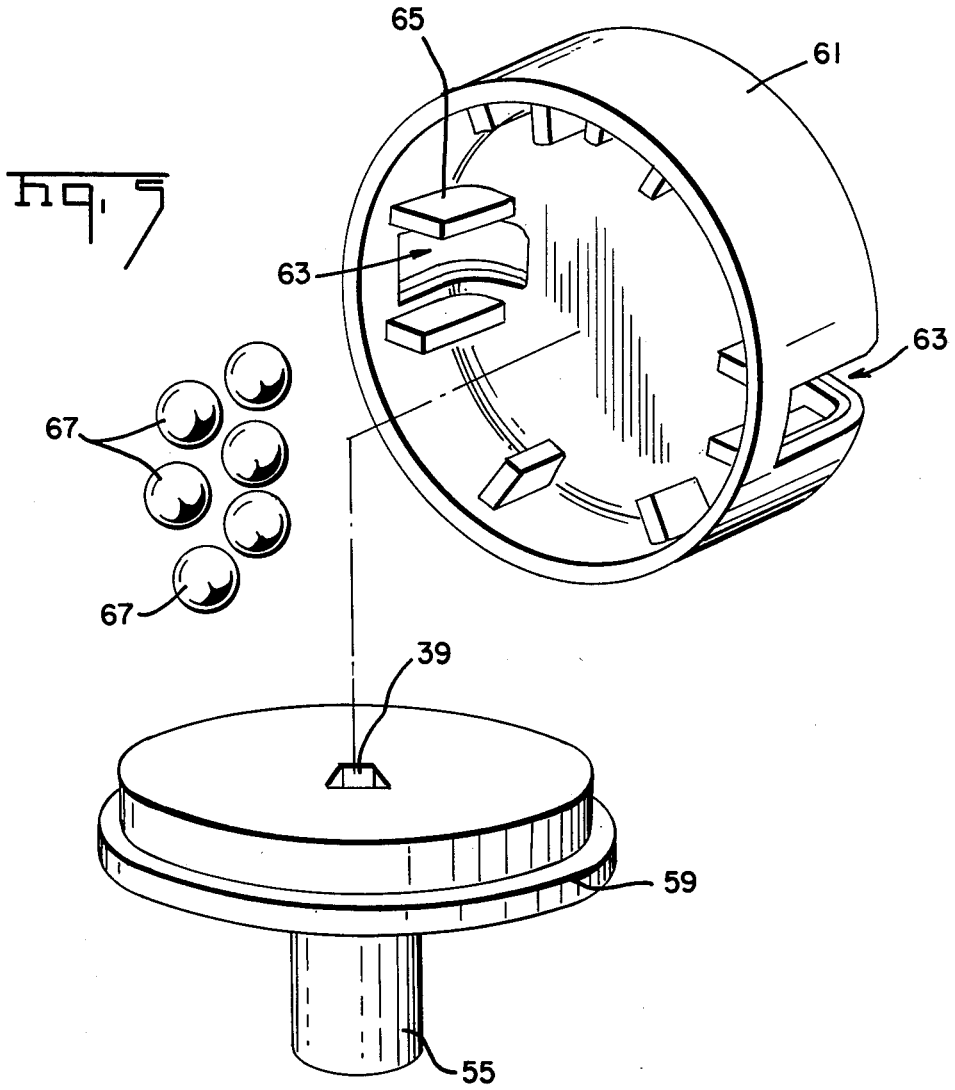
FIG. 5 is an exploded view of the ball tumbler in accordance with the present invention.

Referring now to FIG. 5 there is shown the ball tumbler 45 in greater detail. The ball tumbler includes a shaft portion 55 which is mounted on the shaft 39 as best shown in FIG. 4. Integral with the shaft portion 55 is a bottom portion 57 which includes a lip 59. The top portion 61 fits over the bottom portion 57 and rests on the lip 59, the top portion being secured in that position either by gluing or the like. The top portion includes a pair of windows 63 positioned 180° apart therein. Depending fingers 65 are positioned against the wall on both sides of each window 63 and at other locations to permit balls 27 therein to be randomly mixed and periodically fall into one of the windows 63 between the fingers 65 on either side of such window. Six balls 67 are shown, each, preferably being of a different color corresponding to the colors of the sectors or spaces 13.

Figure 2:
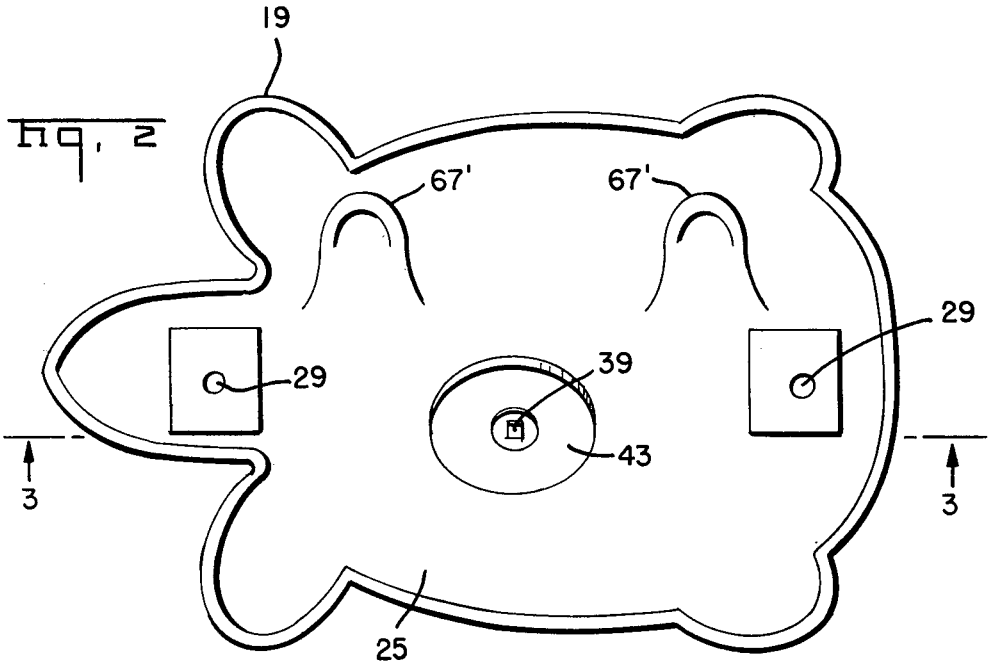
FIG. 2 is a perspective view of the tortoise in accordance with the present invention.

As can be seen from FIGS. 2 and 4, the entire plate and gearing are positioned at an angle to the vertical when the tortoise is positioned substantially with its bottom parallel to the gameboard. For this reason, as can best be seen in FIG. 4, the rubber friction disc 43, which is a rotating wheel, will cause the tortoise to move in an arcuate path around a pair of pivot points 67 which are depending members from plate 25. Rotation of the shaft 39 causes the ball tumbler 45 to rotate therewith. Again, as can be seen from FIG. 4, since the ball tumbler 45 is positioned at an angle to the vertical, when one of the windows 63 is in the lowermost position, a ball 67 will head toward that window due to the force of gravity and away from the window 180° opposite therefrom. Since only one of the balls can fit in a window 63 and between the fingers 65 on either side of the window, only one ball will be visible to the players for every half revolution of the shaft 39. The balls are also continually being mixed due to constant rotation of ball tumbler 45. It can be seen, referring to FIG. 1, that when the tortoise is wound up and placed at the start line, the drive wheel 43 will rotate and cause the tortoise to move in a circular path with a smaller radius of curvature than that of the guide ring 5. Accordingly, one of the legs 19 and 21 will bump against the guide ring and maintain the tortoise movement along the circular path 11 and substantially against the guide ring 5. During this traversal of the circular path 11, the ball tumbler 45 will be rotating and provide a ball of the same or different color at one of the windows 65 twice during each revolution of the shaft 39. The player or players will not observe the ball at the window 63 of the ball tumbler 45 and, each in turn, will move his rabbit to the next space on the tortuous path 3 having the same color as the ball at the window. As stated hereinabove, the spaces 13 will be of different color, corresponding to the balls 67 with some of the spaces having reward or penalty designations. The object of game will now be to either beat the tortoise from the start to the finish line in the event one player is playing against the tortoise, to beat the other players from the start to the finish line in the event plural players are playing, to beat the tortoise and other players from start to finish line in the event plural players are playing or any combination.

It is apparent that the speed and length of the game are determined by the speed of the tortoise about its path since two players take a turn for each revolution of the shaft and the player whose turn has arrived must wait until the next ball is visible in the window. It is therefore apparent that game speed can be controlled by control of speed of rotation of shaft 39.

Though the invention has been described with respect to a specific preferred embodiment thereof, many variations and modifications thereof will immediately become apparent to those skilled in the art. It is therefore the intention that the appended claims be interpreted as broadly as possible in view of the prior art to include all such variations and modifications.

What is claimed is:

1. A game piece which comprises, in combination, (a) a housing having a top and a substantially flat bottom, at least two spaced points of said piece extending below said bottom, (b) a motor means secured within said housing, (c) a shaft driven by said motor means, said shaft being positioned at an acute angle relative to the bottom of said housing.

(d) a wheel secured at one end of said shaft extending below the bottom of said housing and coaxial with said shaft, and (e) a ball tumbler secured at the other end of said shaft, said ball tumbler including at least one window, plural balls therein and a pair of fingers flanking said window and spaced apart by an amount greater than the diameter of one ball and less than the diameter of two balls.

2. A game piece as set forth in claim 1 wherein said ball tumbler includes a pair of windows with flanking fingers, the windows positioned substantially 180° apart.

* * * * *